US011001765B2

(12) United States Patent
van Kimmenade et al.

(10) Patent No.: US 11,001,765 B2
(45) Date of Patent: May 11, 2021

(54) PROCESS FOR COMBINED HYDRODESULFURIZATION AND HYDROCRACKING OF HEAVY HYDROCARBONS

(71) Applicant: SABIC GLOBAL TECHNOLOGIES B.V., Bergen op Zoom (NL)

(72) Inventors: Emiel van Kimmenade, Geleen (NL); Luis Aramburo, Geleen (NL)

(73) Assignee: SABIC GLOBAL TECHNOLOGIES B.V., Bergen Op Zoom (NL)

( * ) Notice: Subject to any disclaimer, the term of this patent is extended or adjusted under 35 U.S.C. 154(b) by 0 days.

(21) Appl. No.: 16/078,423

(22) PCT Filed: Feb. 21, 2017

(86) PCT No.: PCT/EP2017/053865
§ 371 (c)(1),
(2) Date: Aug. 21, 2018

(87) PCT Pub. No.: WO2017/144438
PCT Pub. Date: Aug. 31, 2017

(65) Prior Publication Data

US 2019/0023996 A1 Jan. 24, 2019

(30) Foreign Application Priority Data

Feb. 25, 2016 (EP) ..... 16157347

(51) Int. Cl.
*C10G 45/08* (2006.01)
*C10G 47/02* (2006.01)
*C10G 45/12* (2006.01)

(52) U.S. Cl.
CPC ..... *C10G 45/08* (2013.01); *C10G 45/12* (2013.01); *C10G 47/02* (2013.01); *C10G 2300/1096* (2013.01); *C10G 2300/202* (2013.01); *C10G 2300/4006* (2013.01); *C10G 2300/4012* (2013.01); *C10G 2300/4018* (2013.01); *C10G 2400/30* (2013.01)

(58) Field of Classification Search
None
See application file for complete search history.

(56) References Cited

U.S. PATENT DOCUMENTS

| | | | |
|---|---|---|---|
| 2,479,110 A | 8/1949 | Haensel et al. | |
| 2,604,438 A | 7/1952 | Bannerot | |
| 3,853,747 A | 12/1974 | Young | |
| 4,305,808 A | 12/1981 | Bowes et al. | |
| 4,440,871 A | 4/1984 | Lok et al. | |
| 4,738,766 A | 4/1988 | Fischer et al. | |
| 5,112,473 A | 5/1992 | Dai et al. | |
| 5,468,368 A | 11/1995 | Baker, Jr. et al. | |
| 5,593,570 A | 1/1997 | Habib et al. | |
| 6,444,865 B1 * | 9/2002 | Barre | C10G 45/52 208/143 |
| 7,513,988 B2 | 4/2009 | Oballa et al. | |
| 8,962,900 B2 | 2/2015 | Kim et al. | |
| 2006/0231464 A1 | 10/2006 | Brignac et al. | |
| 2007/0062848 A1 | 3/2007 | Oballa et al. | |
| 2013/0085311 A1 | 4/2013 | Youn et al. | |
| 2015/0166434 A1 | 6/2015 | Ward | |
| 2017/0152447 A1 | 6/2017 | Housmans et al. | |
| 2019/0055479 A1 | 2/2019 | Van Kimmenade et al. | |

FOREIGN PATENT DOCUMENTS

| | | |
|---|---|---|
| CN | 1207117 A | 2/1999 |
| CN | 1253989 A | 5/2000 |
| CN | 1488726 A | 4/2004 |
| CN | 1667093 A | 9/2005 |
| CN | 101619235 A | 1/2010 |
| CN | 103121896 A | 5/2013 |
| CN | 103773480 A | 5/2014 |
| EP | 0247678 A2 | 12/1987 |
| EP | 0303332 A1 | 2/1989 |
| EP | 0512652 A1 | 11/1992 |
| EP | 1779929 A1 | 5/2007 |
| EP | 2258476 A1 | 12/2010 |
| WO | 9321284 A1 | 10/1993 |
| WO | 9838265 A1 | 9/1998 |
| WO | 2004047988 A1 | 6/2004 |
| WO | 2015128019 A1 | 9/2015 |
| WO | 2017148735 A1 | 9/2017 |

OTHER PUBLICATIONS

A. Corma, "Inorganic Solid Acids and Their Use in Acid-Catalyzed Hydrocarbon Reactions" Chemical Reviews vol. 95, No. 3, 1995, pp. 559-614.

Brent M. Lok et al., "Silicoaluminophosphate Molecular Sieves: Another New Class of Microporous Crystalline Inorganic Solids", Journal of Americal Chemical Society, vol. 106, 1984, pp. 6092-6093.

European Search Report issued in EP Application No. 16157347 dated Jul. 26, 2016, 2 pages.

European Search Report issued in EP Application No. 16157968 dated Aug. 30, 2016, 4 pages.

Hermann K. Beyer "Dealumination Techniques for Zeolites" Post-Synthesis Modification I, Molecular Sieves (Science and Technology), vol. 3. Springer, Berlin, Heidelberg, 2002, pp. 203-255.

Huaijun Ma et al., "Coupled hydrogenation and ring opening of tetralin on potassium modified Pt/USY catalysts", Catalysis Letters, vol. 116, Nos. 3-4, Aug. 2007, pp. 149-154.

International Preliminary Report on Patentability issued in Application No. PCT/EP2017/053865; International Filing Date: Feb. 21, 2017; dated Aug. 28, 2018; 8 Pages.

(Continued)

*Primary Examiner* — Tam M Nguyen
(74) *Attorney, Agent, or Firm* — Cantor Colburn LLP

(57) ABSTRACT

The present invention relates to a process for combined hydrodesulfurization and hydrocracking of a heavy hydrocarbon feed comprising contacting the hydrocarbon feed in the presence of hydrogen with a catalyst comprising a mixture of a solid acid catalyst and a hydrodesulfurization catalyst.

17 Claims, No Drawings

(56) References Cited

OTHER PUBLICATIONS

International Preliminary Report on Patentability issued in Application No. PCT/EP2017/053866; International Filing Date: Feb. 21, 2017; dated Sep. 4, 2018, 8 Pages.
International Search Report issued in Application No. PCT/EP2017/053865; International Filing Date: Feb. 21, 2017; dated May 18, 2017; 6 pages.
International Search Report issued in Application No. PCT/EP2017/053866; International Filing Date: Feb. 21, 2017; dated Apr. 18, 2017; 7 pages.
Joo-Il Park et al., "Hydro-conversion of 1-methyl naphthalene into (alkyl)benzenes over alumina-coated USY zeolite-supported NiMoS catalysts", Fuel, vol. 90, 2011, pp. 182-189.
Jovana Zecevic et al., "Heterogeneities of the Nanostructure of Platinum/Zeolite Y Catalysts Revealed by Electron Technology," ACS Nano, vol. 7, No. 4, 2013, pp. 3698-3705.
Karge et al., "Post Synthesis Modification I," Molecular Sieves; 2002, pp. 204-255, vol. 3.
Kirk-Othmer Encyclopedia of Chemical Technology, "Molecular Sieves," (2006) pp. 811-853, Fifth Edition, vol. 16.
Krijn P. De Jong et al., "Zeolite Y Crystals with Trimodal Porosity as Ideal Hydrocracking Catalysts," Angew. Chem. Int. Ed. 2010, vol. 49, pp. 10074-10078.
M. Chareonpanich et al., "Effect of catalysts on yields of monocyclic aromatic hydrocarbons in hydrocracking of coal volatile matter", Fuel, vol. 74, No. 11, 1995, pp. 1663-1640.
Ocean Cheung et al., "Silicoaluminophosphates as CO2 sorbents", Microporous and Mesoporous Materials, vol. 156, 2012, pp. 90-96.
Written Opinion of the International Searching Authority issued in International Application No. PCT/EP2017/053865; International Filing Date: Feb. 21, 2017; dated May 18, 2017; 9 pages.
Written Opinion of the International Searching Authority issued in International Application No. PCT/EP2017/053866; International Filing Date: Feb. 21, 2017; dated Apr. 18, 2017; 7 pages.
Zeolite Structure, Framework Type Data, "Type Material: CHABAZITE," CHA, pp. 96-97.
Julius Scherzer et al., "Hydrocracking Science and Technology" CRC Press, vol. 66. 1996, 3 pages.
Scherzer, et al. (Hydrocracking Science and Technology Crc Press, 1996, p. 63) (Year: 1996).

* cited by examiner

PROCESS FOR COMBINED HYDRODESULFURIZATION AND HYDROCRACKING OF HEAVY HYDROCARBONS

CROSS REFERENCE TO RELATED APPLICATIONS

This application is a 371 of International Application No. PCT/EP2017/053865, filed Feb. 21, 2017, which claims priority to European Application Serial No. 16157347.2, filed Feb. 25, 2016, which are incorporated herein by reference in their entirety.

The present invention relates to a process for combined hydrodesulfurization and hydrocracking of a heavy hydrocarbon feed comprising contacting the hydrocarbon feed in the presence of hydrogen with a catalyst comprising a mixture of a solid acid catalyst and a hydrodesulfurization catalyst.

Processes for converting heavy hydrocarbon streams into light aromatics and a paraffin or LPG stream have been previously described. For instance, U.S. Pat. No. 7,513,988 B2 describes a process for hydrocracking a feed comprising not less than 20 weight % of one or more aromatic compounds containing at least two fused aromatic rings which compounds are unsubstituted or substituted by up to two C1-4 alkyl radicals to produce a product stream comprising not less than 35 weight % of a mixture of C2-4 alkanes comprising: (i) passing said feed stream to a ring saturation unit at a temperature from 300° C. to 500° C. and a pressure from 2 to 10 MPa together with from 100 to 300 kg of hydrogen per 1,000 kg of feedstock over an aromatic hydrogenation catalyst to yield a resulting stream in which not less than 60 weight % of said one or more aromatic compounds containing at least two rings which compounds are unsubstituted or substituted by up to two C1-4 alkyl radicals at least one of the aromatic rings has been completely saturated; (ii) passing the resulting stream to a ring cleavage unit at a temperature from 200° C. to 600° C. and a pressure from 1 to 12 MPa together with from 50 to 200 kg of hydrogen per 1,000 kg of said resulting stream over a ring cleavage catalyst to product the product stream; and (iii) separating the product stream into a C2-4 alkanes stream, a liquid paraffinic stream and an aromatic stream.

U.S. Pat. No. 8,962,900 B2 describes a method of producing aromatics and light paraffins that inter alia comprises introducing oils derived from oil, coal or wood into a hydrogenation and reaction area comprising a hydroprocessing process and a hydrocracking process; hydroprocessing the oils in the presence of a hydroprocessing catalyst to partially saturate aromatic components having two or more aromatic rings into aromatic components having one aromatic ring, such that an amount of aromatic components having one aromatic ring in the oils is increased and hydrocracking the hydroprocessed oils in the presence of a hydrocracking catalyst to form hydrocracked oils.

These conventional processes are characterized in that they make use of separate hydrotreating stages which are optimized to break carbon-sulfur bonds and/or carbon-nitrogen bonds to remove the sulfur and other unwanted heteroatoms like nitrogen from the feed and hydrocracking stages which are optimized to break carbon-carbon bonds to break down the hydrocarbons into lighter hydrocarbons.

It was an object of the present invention to provide an improved process for combined hydrodesulfurization and hydrocracking of a heavy hydrocarbon feed, which allows simultaneous hydrodesulfurization and hydrocracking.

The solution to the above problem is achieved by providing the embodiments as described herein below and as characterized in the claims. Accordingly, the present invention provides a process for combined hydrodesulfurization and hydrocracking of a heavy hydrocarbon feed comprising contacting said heavy hydrocarbon feed in the presence of hydrogen at process conditions comprising a temperature of 350-475° C. and a pressure of 2500-4500 kPa with a catalyst comprising a mixture of a solid acid catalyst and a hydrodesulfurization catalyst, wherein said hydrodesulfurization catalyst comprises 1-30 wt-% of one or more elements selected from Group 6 of the Periodic Table of Elements based on the total weight of the hydrodesulfurization catalyst, 0.1-10 wt-% of one or more elements selected from Groups 9 and 10 of the Periodic Table of Elements based on the total weight of the hydrodesulfurization catalyst and a solid catalyst support, and wherein said solid acid catalyst is comprises an aluminosilicate zeolite having a $SiO_2/Al_2O_3$ molar ratio of 50-120.

In the context of the present invention, it was surprisingly found that by specifically selecting a catalyst comprising a mixture of aluminosilicate zeolite having a $SiO_2/Al_2O_3$ molar ratio of 50-120 and a hydrodesulfurization catalyst as defined herein in combination with the process conditions as defined herein, a heavy hydrocarbon feed comprising aromatic hydrocarbons having more than one aromatic ring and that is relatively rich in sulfur can be efficiently hydrodesulfurized and hydrocracked in a single combined hydrodesulfurization and hydrocracking process with a surprisingly improved selectivity to mono-aromatic hydrocarbons.

WO 93/21284 A1 describes a physically intermixed catalyst system comprising two distinctly different catalytic particles, the first of which is a hydrodenitrification and/or hydrodesulfurization catalyst and the second of which is a relatively active hydrocracking catalyst, wherein the catalyst particles of both catalytic components are substantially the same size. The hydrocracking catalyst of WO 93/21284 A1 preferably is a zeolitic catalyst selected from the Y-zeolite family. WO 93/21284 A1 does not describe an aluminosilicate zeolite having a $SiO_2/Al_2O_3$ molar ratio of 50-120.

EP 1 779 929 A1 describes a catalyst composition for the reaction of hydrocarbons comprising a zeolite having faujasite structure and a fibrous zeolite which comprises essentially non-crossing one-dimensional channels. EP 1 779 929 A1 fails to describe a catalyst composition comprising a zeolite having a $SiO_2/Al_2O_3$ molar ratio of 50-120.

WO 98/38265 A1 describes a process for hydrorefining a hydrocarbon stream containing alkyl substituted condensed ring heteroryclic sulfur compounds comprising contacting said stream under hydrodesulfurization conditions and in the presence of hydrogen with a catalyst system comprising (a) hydrosedulfurization catalyst comprising a sulfided transition metal promoted molybdenum and/or tungsten metal catalyst; and (b) a solid acid catalyst effective for the isomerization and/or transalkylation of alkyl substituent groups present on said heterocyclic compounds under said hydrodesulfurization conditions. Also WO 98/38265 A1 fails to describe a catalyst composition comprising a zeolite having a $SiO_2/Al_2O_3$ molar ratio of 50-120.

The term "aromatic hydrocarbons" or "aromatics" Is very well known in the art. Accordingly, the term "aromatic hydrocarbon" relates to cyclically conjugated hydrocarbon with a stability (due to delocalization) that is significantly greater than that of a hypothetical localized structure (e.g. Kekuld structure). The most common method for determining aromaticity of a given hydrocarbon is the observation of diatropicity in the $^1H$ NMR spectrum, for example the presence of chemical shifts in the range of from 7.2 to 7.3 ppm for benzene ring protons. As used herein, the term "polyaromatics" or "polyaromatic hydrocarbons" relates to a mixture of aromatic hydrocarbons having more than one aromatic ring. As used herein, the term "monoaromatic hydrocarbons" or "monoaromatics" relates to a mixture of aromatic hydrocarbons having only one aromatic ring.

The term "BTX" as used herein relates to a mixture of benzene, toluene and xylenes.

As used herein, the term "C# hydrocarbons", or "C#", wherein "#" Is a positive integer, is meant to describe all hydrocarbons having # carbon atoms. Moreover, the term "C#+ hydrocarbons" Is meant to describe all hydrocarbon molecules having # or more carbon atoms. Accordingly, the term "C9+ hydrocarbons" Is meant to describe a mixture of hydrocarbons having 9 or more carbon atoms. The term "C9+ alkanes" accordingly relates to alkanes having 9 or more carbon atoms.

The term "LPG" as used herein refers to the well-established acronym for the term "liquefied petroleum gas". LPG generally consists of a blend of C2-C4 hydrocarbons i.e. a mixture of C2, C3, and C4 hydrocarbons.

The present invention provides a process for combined hydrodesulfurization and hydrocracking of a heavy hydrocarbon feed.

The term "hydrocarbon feed" as used herein relates to the hydrocarbon mixture that is subjected to the process of the present invention. As used herein, the term "heavy hydrocarbon" Is used in its generally accepted meaning in the field of petroleum refinery processes. Preferably, the heavy hydrocarbon feed relates to a mixed hydrocarbon feed that may be obtained after crude distillation or that may be derived from a refinery unit having a boiling point of more than 340° C., more preferably of more than 350° C. Preferably, the heavy hydrocarbon feed comprises at least 30 wt-% polyaromatics, preferably at least 50 wt-% polyaromatics.

Preferably, the heavy hydrocarbon feed comprises at least 100 wppm sulfur, more preferably at least 500 wppm sulfur, even more preferably at least 1000 wppm sulfur, particularly preferably at least 5000 wppm and most preferably at least 10,000 wppm sulfur.

Preferably, the heavy hydrocarbon feed comprises one or more selected from the group consisting of heavy cycle oil, light cycle oil, carbon black oil, cracked distillate and pyoil.

The process of the present invention comprises contacting the heavy hydrocarbon feed in the presence of hydrogen at process conditions comprising a temperature of 350-475° C. and a pressure of 2500-4500 kPa with a catalyst.

Preferably, the process conditions comprise a temperature of 370-465° C., more preferably a temperature of 400-455° C.

Preferably, the process conditions comprise a pressure of 2700-4000 kPa, more preferably a pressure of 2800-3500 kPa.

Preferably, the process conditions further comprise a Weight Hourly Space Velocity (WHSV) of 0.05-5 $h^{-1}$, more preferably a WHSV of 0.1-1.5 $h^{-1}$.

In the process of the present invention, the catalyst comprises a mixture of a solid acid catalyst comprising an aluminosilicate zeolite having a $SiO_2/Al_2O_3$ molar ratio of 50-120 and a hydrodesulfurization catalyst, wherein said hydrodesulfurization catalyst comprises 1-30 wt-% of one or more elements selected from Group 6 of the Periodic Table of Elements based on the total weight of the hydrodesulfurization catalyst, 0.1-10 wt-% of one or more elements selected from Groups 9 and 10 of the Periodic Table of Elements and a solid catalyst support based on the total weight of the hydrodesulfurization catalyst.

Accordingly, the catalyst composition used in the process of the present invention is a mixture comprising a solid acid catalyst and a hydrodesulfurization catalyst. Preferably, the catalyst composition used in the process of the present invention is a mixture comprising 10-90 wt-% solid add catalyst and 10-90 wt-% hydrodesulfurization catalyst, more preferably the catalyst composition used in the process of the present invention is a mixture comprising 20-80 wt-% solid acid catalyst and 20-80 wt-% hydrodesulfurization catalyst, even more preferably the catalyst composition used in the process of the present invention is a mixture comprising 30-70 wt-% solid acid catalyst and 30-70 wt-% hydrodesulfurization catalyst, most preferably the catalyst composition used in the process of the present invention is a mixture comprising 40-60 wt-% solid acid catalyst and 40-60 wt-% hydrodesulfurization catalyst.

Hydrodesulfurization catalysts are well known in the art and generally comprise metal oxides or sulfides of, for instance Co, Mo, W and/or NI, supported on a catalyst support, such as alumina; see e.g. U.S. Pat. No. 2,604,438. Preferably, the one or more elements selected from Groups 9 and 10 of the Periodic Table of Elements comprised in the hydrodesulfurization catalyst is Co and/or NI. Preferably, the elements comprised in the hydrodesulfurization catalyst are in sulfide form. Preferably, the hydrodesulfurization catalyst comprises one or more selected from the group consisting of $CoMoS_2$, $NiMoS_2$, $NiWS_2$ and $CoWS_2$.

Solid acid catalyst compositions are well known in the art and are for example described in Corma (1995) Chem Rev 95, 559-614. Accordingly, a solid acid catalyst composition may be described as a solid catalyst component having Bronsted and/or Lewis acidity. The solid acid catalyst may be an acidic solid material or a non-acidic solid material having acid components anchored to it. The acidic property of the solid acid catalyst must be exposed to the reaction medium, which may be a gas or liquid. The solid acid catalyst used in the process of the present invention comprises o an aluminosilicate zeolite having a $SiO_2/Al_2O_3$ molar ratio of 50-120.

Other solid acid catalysts are known from the prior art including, but not limited to chlorinated alumina and silicoaluminophosphate zeolite (SAPO). Chlorinated alumina is well-known from the prior art and is, for example, described in U.S. Pat. No. 2,479,110 A. Silcoaluminophosphate zeolite (SAPO) is also well-known from the prior art and is, for example, described in U.S. Pat. No. 4,440,871.

As used herein, the term "aluminosilicate zeolite" relates to an aluminosilicate molecular sieve. An overview of their characteristics is for example provided by the chapter on Molecular Sieves in Kirk-Othmer Encyclopedia of Chemical Technology, Volume 16, p 811-853; In Atlas of Zeolite Framework Types, 5th edition, (Elsevier, 2001). Preferably, the aluminosilicate zeolite is a large pore size aluminosilicate zeolite. Suitable large pore aluminosilicate zeolites include, but are not limited to, zeolite Y, faujasite (FAU), beta zeolite (BEA), and chabazite (CHA). The term "large pore aluminosilicate zeolite" Is commonly used in the field of zeolite catalysts. Accordingly, a large pore size aluminosilicate zeolite is an aluminosilicate zeolite having a pore size of 6-8 Å.

Preferably, the solid acid catalyst comprises aluminosilicate zeolite having a 12-ring structure. These specific aluminosilicate zeolites are well known to the skilled man. An overview of their characteristics is for example provided by the Atlas of Zeolite Framework Types, 5th edition, (Elsevier, 2001). Accordingly, an aluminosilicate zeolite having a 12-ring structure is an aluminosilicate zeolite wherein the pore is formed by a ring consisting of 12 $[SiO_4]$ or $[AlO_4]^+$ tetrahedra.

Preferably, the aluminosilicate zeolite has super cages having a size of 12-14 Å. Means and methods for preparing zeolites comprising super cages are well-known in the art and comprise zeolite post-treatments such as acid leaching and steaming, among others. (Angew. Chem., Int. Ed. 2010, 49, 10074, ACS nano, 4 (2013) 3698).

Preferably, the aluminosilicate zeolite is zeolite Y. Depending on the silica-to-alumina molar ratio ("$SiO_2/Al_2O_3$ molar ratio" or "$SiO_2/Al_2O_3$ ratio") of its framework, synthetic faujasite zeolites are divided into zeolite X and zeolite Y. In X zeolites the $SiO_2/Al_2O_3$ ratio is between 2 and 3, while in Y zeolites it is 3 or higher. Accordingly, zeolite Y is a synthetic faujasite zeolite having a $SiO_2/Al_2O_3$ ratio in its framework of 3 or more. Preferably, the zeolite in the catalyst is in the so-called hydrogen form, meaning that its sodium or potassium content is very low, preferably below 0.1, 0.05, 0.02 or 0.01 wt-%; more preferably the presence of sodium is below detection limits. Preferably, the zeolite Y used in the process of the present invention has a $SiO_2/Al_2O_3$ ratio of 50-120, more preferably a $SiO_2/Al_2O_3$ ratio of 60-100. Preferably, the partially dealuminated zeolite is prepared by controlling $SiO_2/Al_2O_3$ ratio during zeolite synthesis. Alternatively, the zeolite may be partially dealuminated by a post-synthesis modification. Means and methods to obtain dealuminated zeolite by post-synthesis modification are well-known in the art and include, but are not limited to the acid leaching technique; see e.g. Post-synthesis Modification I; Molecular Sieves, Volume 3; Eds. H. G. Karge, J. Weitkamp; Year (2002); Pages 204-255.

The aluminosilicate zeolite used in the present invention has a $SiO_2/Al_2O_3$ molar ratio of 50-120, preferably a $SiO_2/Al_2O_3$ molar ratio of 60-100. Means and methods for quantifying the $SiO_2$ to $Al_2O_3$ molar ratio of a zeolite are well known in the art and include, but are not limited to AAS (Atomic Absorption Spectroscopy), ICP (Inductively Coupled Plasma Spectrometry) analysis or XRF (X-ray fluorescence). It is noted that the $SiO_2$ to $Al_2O_3$ molar ratio referred herein is meant as the ratio in the zeolite prior to being mixed with the binder for forming the shaped body. Preferably, the $SiO_2$ to $Al_2O_3$ molar ratio is measured by XRF.

The process of the present invention converts the heavy hydrocarbon feed into a mixed product stream comprising aromatics, such as BTX, and paraffins, such as naphthenes and LPG.

It is an advantage of the process of the present invention that it is not necessary to subject the hydrocarbon feedstream to a desulfurisation treatment prior to subjecting said hydrocarbon feedstream to the process of the present invention. Preferably, the product produced in the process of the present invention comprises 0.1-50 wppm of Sulfur. Methods for the measurement of the sulfur content in a hydrocarbons stream are well known. Preferably, the sulfur content is measured using the IP 490 standard; see also ISO 20846:2011. Accordingly, samples are introduced into a pyrolysis furnace, where the sample is oxidised at high temperature in an oxygen atmosphere. All sulfur in the sample is oxidised to $SO_2$. The $SO_2$ is exposed to ultraviolet light, causing it to fluoresce. The light emitted by the fluorescence is detected by a photomultiplier, and the resulting signal is proportional to the sulfur content of the sample.

It is noted that the invention relates to all possible combinations of features described herein, particularly features recited in the claims.

It is further noted that the term "comprising" does not exclude the presence of other elements. However, it is also to be understood that a description on a product comprising certain components also discloses a product consisting of these components. Similarly, it is also to be understood that a description on a process comprising certain steps also discloses a process consisting of these steps.

EXAMPLE 1

All catalyst mixtures used in the Examples are based on a 1 to 1 weight ratio of the hydrotreating/hydrogenation catalyst versus the zeolite. Particle size of all catalysts was in the order of 100 to 150 μm and obtained by ball milling and sieving. As the zeolite was available as a powder it first had to be bounded with alumina to increase the particle size. This was done by using Disperal. The procedure is as follows: Zeolite, Disperal and water are mixed in 7:3:40 weight ratio respectively. The slurry is then ball milled for 15 minutes at 600 rpm with balls of 1.3 mm diameter. After milling the slurry is dried at 120° C. In an open beaker after which the particles are transferred into a hotbox for overnight drying at 110° C. The next day the material was calcined at 300° C. for 6 hours.

In the case a mixture of catalysts was used the loading of catalysts into the reactor was done careful in order to obtain a homogeneous mixture.

The used catalysts were the following commercially available catalysts: presulflded CoMoS2: Axens LD145S; presulfided NIMoS2: Axens HR406S; Pt: UOP R12; Zeolite Y: Zeolyst CBV780 and CBV712.

All catalyst and catalyst mixtures were activated in situ. First the reactor was purged with nitrogen up to 60° C. Then a flow of hydrogen was introduced and the reactor was heated at 1° C./min to a temperature of 400° C. This temperature was maintained for 2 hours before the reactor was allowed to cool in hydrogen flow. It should be mentioned here that the CoMo and NIMo catalysts were in presulflded form and that the active metal sulfides were formed in the activation procedure without the need to use $H_2S$.

Tests have been performed to process in a single step a di- and tri-aromatics containing hydrocarbon stream spiked with sulfur species (about 1 w % S). To mimic Light Cycle Oil (LCO) a model feed was used having the composition given in Table 1. All experiments were performed with a 10 to 1 hydrogen to hydrocarbon molar ratio.

TABLE 1

Model feed composition details.

| Model Feed | |
|---|---|
| Decane | 22.3 wt % |
| Propylbenzene | 19.5 wt % |
| Naphthalene | 25.3 wt % |
| 1-Methylnaphthalene | 14.8 wt % |
| 2-Methylnaphthalene | 9.7 wt % |
| Anthracene | 2.0 wt % |
| Phenantrene | 3.1 wt % |
| Dimethyldisulfide | 0.2 wt % |
| Benzothiophene | 1.3 wt % |
| Dibenzothiophene | 1.6 wt % |
| Dimethyl-dibenzothiophene | 0.2 wt % |

The model feed was exposed to different catalyst mixtures in a single fixed bed at 30 bars and temperatures ranging from 250 to 450° C. in a 16 parallel reactor setup. Table 2 summarizes the results obtained for different catalyst systems at temperatures of 350, 400 and 450° C. The results show that: (1) ring opening can be achieved with a low to medium selectivity towards mono-aromatics using standard hydrotreating catalysts at temperatures of 350° C. and above; (2) ring opening can be achieved with a high selectivity towards mono-aromatics using mixtures of standard hydrotreating catalysts and zeolite Y at temperatures of 400° C. and above; and (3) hydrodesulfurization performance for the catalyst mixture at high selectivity conditions (400° C. and above) is sufficient to remove all sulfur. Moreover, it was found that the ring opening conversion is higher when using a mixture of a standard hydrotreating catalysts and zeolite Y as a catalyst when compared to using only a hydrotreating catalyst.

This means that by using a mixture of standard hydrotreating catalysts and zeolite Y at 30 bars and at temperatures around 400° C. and higher both hydrodesulfurization and high selectivity ring opening can be achieved. With using catalyst mixtures both the rate of ring opening and the selectivity towards mono-aromatics increase with increasing temperature up to 450° C.

At the weight hourly space velocities (WHSV or the feed rate relative to the catalyst amount) used in these experiments only low to medium ring opening conversion levels were achieved (up to 30%). By reducing the WHSV (e.g. increasing the amount of catalyst) full conversion can be achieved at high selectivity.

TABLE 2a

Ring opening conversion, mono-aromatics yield, sulfur component reduction and mono-aromatics selectivity for different pure CoMoS2 and NiMoS2 catalysts.

| Catalyst and reaction temperature | Mono-aromatics gain | Sulfur component reduction | Di- and tri-aromatics ring open conversion | Selectivity to mono-aromatics (molar) |
|---|---|---|---|---|
| CoMoS 350 C. | 4.28 | 100 | 8.25 | 23.38 |
| NiMoS 350 C. | 7.84 | 100 | 4.74 | 41.21 |
| CoMoS 400 C. | −1.06 | 100 | 6.85 | 1.71 |
| NiMoS 400 C. | 8.98 | 100 | 9.04 | 42.42 |
| CoMoS 450 C. | 6.54 | 100 | 4.54 | 50.56 |
| NiMoS 450 C. | 12.21 | 100 | 7.25 | 61.93 |

TABLE 2b

Ring opening conversion, mono-aromatics yield, sulfur component reduction and mono-aromatics selectivity for catalyst mixtures.

| Catalyst and reaction temperature | Mono-aromatics gain | Sulfur component reduction | Di- and tri-aromatics ring open conversion | Selectivity to mono-aromatics (molar) |
|---|---|---|---|---|
| CoMoS + Z12 350 C. | 8.04 | 97.62 | 6.24 | 55.08 |
| NiMoS + Z12 350 C. | 12.02 | 96.50 | 7.69 | 66.19 |
| CoMoS + Z80 400 C. | 19.04 | 100 | 17.90 | 64.15 |
| NiMoS + Z12 400 C. | 18.18 | 100 | 15.82 | 77.12 |

TABLE 2b-continued

Ring opening conversion, mono-aromatics yield, sulfur component reduction and mono-aromatics selectivity for catalyst mixtures.

| Catalyst and reaction temperature | Mono-aromatics gain | Sulfur component reduction | Di- and tri-aromatics ring open conversion | Selectivity to mono-aromatics (molar) |
|---|---|---|---|---|
| CoMoS + Z80 450 C. | 50.93 | 100 | 31.19 | 93.44 |
| NiMoS + Z12 450 C. | 30.39 | 100 | 19.53 | 86.39 |

EXAMPLE 2

The ring opening performance of the catalyst mixtures used in Example 1 is very similar to the performance seen with mixtures of a platinum catalyst and zeolite Y. The noble metal catalyst mixture, which would require a preliminary separate hydrodesulfurization, exhibits slightly higher activity but lower selectivity. In this Example 2, a similar feed was used, however without the sulfur components; see Table 3.

TABLE 3

Sulfur free model feed composition details.

| Model Feed | |
|---|---|
| Decane | 25 wt % |
| Propylbenzene | 20 wt % |
| Naphthalene | 25 wt % |
| 1-Methylnaphthalene | 15 wt % |
| 2-Methylnaphthalene | 10 wt % |
| Anthracene | 2 wt % |
| Phenantrene | 3 wt % |

For the sulfur-free feed as described in Table 3, the performance of all catalyst mixtures at 30 bar reactor pressure are summarized in Table 4

TABLE 4

Comparison in ring opening using catalyst mixtures based on sulfide hydrotreating catalysts and a noble metal catalyst.

| | Mono-aromatics gain | Di- and tri-aromatics ring open conversion | Selectivity to mono-aromatics (molar) |
|---|---|---|---|
| CoMoS + Z80 450 C. | 50.92736 | 31.18762 | 93.43918 |
| NiMoS + Z12 450 C. | 30.39208 | 19.53333 | 86.39491 |
| Pt + Z80 450 C. | 40.98492 | 37.33832 | 69.41478 |
| CoMoS + Z12 450 C. | 20.42945 | 20.27985 | 80.45720 |
| Pt + Z12 450 C. | 26.85155 | 19.75324 | 75.45768 |

The invention claimed is:

1. A process for combined hydrodesulfurization and hydrocracking of a heavy hydrocarbon feed comprising:

contacting said heavy hydrocarbon feed in the presence of hydrogen at process conditions comprising a temperature of 400-455° C. and a pressure of 2500-4500 kPa, with a catalyst comprising a mixture of a solid acid catalyst and a hydrodesulfurization catalyst, wherein sulfur is at least partially removed from the heavy hydrocarbon feed;

a mono-aromatic yield of about 19% to about 52%;

a sulfur component reduction of greater than or equal to about 96%;

a di and tri-aromatic ring opening conversion of about 17% to about 38%;

a molar selectivity to mono-aromatics of about 64% to about 94%;

wherein said hydrodesulfurization catalyst comprises 1-30 wt-% of an element selected from Group 6 of the Periodic Table of Elements based on the total weight of the hydrodesulfurization catalyst, and 0.1-10 wt-% of an element selected from Groups 9 and 10 of the Periodic Table of Elements based on the total weight of the hydrodesulfurization catalyst and a solid catalyst support, and wherein said solid acid catalyst comprises an aluminosilicate zeolite Y having a $SiO_2/Al_2O_3$ molar ratio of 60-100.

2. The process according to claim 1, wherein the element selected from Groups 9 and 10 of the Periodic Table of Elements is Co and/or Ni.

3. The process according to claim 1, wherein the element in the hydrodesulfurization catalyst is in sulfide form.

4. The process according to claim 1, wherein the hydrodesulfurization catalyst comprises one or more selected from the group consisting of $CoMoS_2$, $NiMoS_2$, $NiWS_2$ and $CoWS_2$.

5. The process according to claim 1, wherein the solid acid catalyst comprises aluminosilicate zeolite having a 12-ring structure.

6. The process according to claim 5, wherein the aluminosilicate zeolite has super cages having a size of 12-14 Å.

7. The process according to claim 1, wherein the process conditions comprise a pressure of 2700-4000 kPa.

8. The process according to claim 1, wherein the process conditions further comprise a Weight Hourly Space Velocity (WHSV) of 0.05-5 $h^{-1}$.

9. The process according to claim 1, wherein the heavy hydrocarbon feed comprises at least 30 wt-% polyaromatics.

10. The process according to claim 1, wherein the heavy hydrocarbon feed comprises at least 100 wppm sulfur.

11. The process according to claim 1, wherein the heavy hydrocarbon feed comprises one or more selected from the group consisting of heavy cycle oil, light cycle oil, carbon black oil, cracked distillate and pyoil.

12. The process according to claim 1, wherein the pressure is 2800-3500 kPa, wherein the WHSV of 0.1-1.5 $h^{-1}$, and wherein the heavy hydrocarbon feed comprises at least 50 wt-% polyaromatics.

13. The process according to claim 12, wherein the heavy hydrocarbon feed comprises at least 5000 wppm sulfur.

14. A process for combined hydrodesulfurization and hydrocracking of a heavy hydrocarbon feed comprising:

contacting said heavy hydrocarbon feed in the presence of hydrogen at process conditions comprising a temperature of 400-455° C., a Weight Hourly Space Velocity (WHSV) of 0.05-5 $h^{-1}$, and a pressure of 2800-3500 kPa, with a catalyst comprising a mixture of a solid acid catalyst and a hydrodesulfurization catalyst, wherein sulfur is at least partially removed from the heavy hydrocarbon feed;

a mono-aromatic yield of about 19% to about 52%;

a sulfur component reduction of greater than or equal to about 96%;

a di- and tri-aromatic ring opening conversion of about 17% to about 38%;

a molar selectivity to mono-aromatics of about 64% to about 94%;

wherein the heavy hydrocarbon feed comprises at least 30 wt-% polyaromatics, wherein the solid acid catalyst comprises aluminosilicate zeolite having a 12-ring structure and having super cages having a size of 12-14 Å, wherein said hydrodesulfurization catalyst comprises 1-30 wt-% of Co and/or Ni based on the total weight of the hydrodesulfurization catalyst, and 0.1-10 wt-% of an element selected from Groups 9 and 10 of the Periodic Table of Elements based on the total weight of the hydrodesulfurization catalyst and a solid catalyst support, and wherein said solid acid catalyst comprises an aluminosilicate zeolite Y having a $SiO_2/Al_2O_3$ molar ratio of 60-100.

15. The process according to claim 1, wherein the hydrodesulfurization catalyst comprises one or more selected from the group consisting of $CoMoS_2$, $NiMoS_2$, $NiWS_2$ and $CoWS_2$.

16. The process according to claim 1, wherein the WHSV is 0.1-1.5 $h^{-1}$.

17. The process according to claim 1, wherein the heavy hydrocarbon feed comprises at least 50 wt-% polyaromatics, and comprises at least 1000 wppm sulfur.

* * * * *